US007533730B1

(12) United States Patent
Corsentino

(10) Patent No.: US 7,533,730 B1
(45) Date of Patent: May 19, 2009

(54) VARIABLE AND SLOW SPEED PUMPING UNIT

(75) Inventor: Mark Corsentino, Trinidad, CO (US)

(73) Assignee: XTO Energy Inc., Fort Worth, TX (US)

( * ) Notice: Subject to any disclaimer, the term of this patent is extended or adjusted under 35 U.S.C. 154(b) by 329 days.

(21) Appl. No.: 11/538,712

(22) Filed: Oct. 4, 2006

(51) Int. Cl.
*E21B 43/12* (2006.01)

(52) U.S. Cl. ..... 166/369; 166/250.15; 166/68.5

(58) Field of Classification Search ..... 166/369, 166/53, 250.15, 68.5; 60/431
See application file for complete search history.

(56) References Cited

U.S. PATENT DOCUMENTS 5,251,696 A * 10/1993 Boone et al. ..... 166/250.15
5,462,116 A * 10/1995 Carroll ..... 166/249
5,823,262 A * 10/1998 Dutton ..... 166/250.15
6,497,281 B2 * 12/2002 Vann ..... 166/250.15
6,938,719 B2 * 9/2005 Ishimaru et al. ..... 180/305
2004/0084179 A1 * 5/2004 Watson et al. ..... 166/250.15

* cited by examiner

*Primary Examiner*—William P Neuder
(74) *Attorney, Agent, or Firm*—Holland & Hart LLP

(57) ABSTRACT

A pumping unit is provided with a hydraulic drive unit. The drive includes a hydraulic motor attached to a driven sheave that, through reduction gears, drives a drive shaft and crank arm that causes the pumping unit to pump. The speed of the hydraulic motor is controlled by hydraulic pump in fluid communication with the hydraulic motor. A prime mover drives the hydraulic pump. The speed of the hydraulic pump (and the hydraulic motor by correlation) is controlled by a speed control on the prime mover and/or a flow control valve.

12 Claims, 4 Drawing Sheets

VARIABLE AND SLOW SPEED PUMPING UNIT

CLAIM OF PRIORITY UNDER 35 U.S.C. §119

None.

CLAIM OF PRIORITY UNDER 35 U.S.C. §120

None.

REFERENCE TO CO-PENDING APPLICATIONS FOR PATENT

None.

BACKGROUND

1. Field

The technology of this present application relates to pumping water from coal/gas and oil wells, and more specifically to a variable and slow speed pumps useful in pumping water from coal/gas and oil wells.

2. Background

Coal/gas and oil wells have been in existence for a number of years. One recognized problem associated with drilling coal/gas wells, as well as other hydrocarbon production wells, relates to liquids (typically water) accumulating in the wellbore. As the liquid builds in the wellbore, hydrostatic pressure builds and can become a significant counter force to the recovery of gas. If left unchecked, the pressure may become so high as to effectively "kill" the well.

Generally, fluids including both liquids and gases flow from the hydrocarbon formations. The liquids typically accumulate as a result of condensing and falling out of the gas stream, or seepage from the hydrocarbon formation. The building of the liquid in the wellbore results in the hydrostatic pressure mentioned above. While initial formation pressures may be sufficient to overcome the initial build up of hydrostatic pressure, over time the pressure in the formation decreases as the hydrocarbon is removed until the formation pressure is insufficient, which exasperates the problem.

Many techniques have been developed to counter act the problem. These techniques generally include removing the liquids that accumulate in the wellbore, such as, for example, by lifting the liquid uphole. Other techniques recycle the water back to the formation.

One common solution involves the use of a progressive cavity pump. Using the progressive cavity pump, formations that produce high water volumes and coal fines can be successfully dewatered. However, as the water volume produced by the well diminishes, the progressive cavity pump experiences operational issues as the fluid level drops resulting in decreases lubrication and increased heat generation of the pump. Operating a progressive cavity pump in these conditions eventually overheats the pump resulting in "burning the pump."

Some companies combat the low water levels by replacing the progressive cavity pump with a rod insert pump. The rod insert pump pumps at a lower rate than the progressive cavity pump and can allow further reductions in water levels over what is achievable with a conventional progressive cavity pump. Rod insert pumps, however, have drawbacks as well. For example, as the water level is lowered, the rod insert pump may not need to be continuously run resulting in a chance of sticking causing mechanical stresses on the pump, the well, and the like.

Other issues with the above referenced and other conventional pumps is it is difficult to adjust the operating speed of the pumps. Thus, a large water surge may cause an operator to increase pump speed to accommodate the increase in water production. However, when the water product decreases, the sudden decrease in water level can cause a pressure surge from the formation causing problems with the well, such as, for example, additional coal fines in the wellbore.

Thus, against the above background, it would be desirous to develop and improved apparatus and method to remove fluid from a wellbore.

SUMMARY

Embodiments disclosed herein address the above stated needs by providing a variable speed drive for a pumping unit. The variable speed drive of the pumping unit includes a pumping unit drive coupled to the pumping unit. The pumping unit drive is coupled to a hydraulic motor that is in fluid communication with the hydraulic pump. A prime mover coupled to the hydraulic pump. A speed of the prime mover controls the speed of the pumping unit such that increasing the speed of the prime mover correspondingly increases the pumping unit and a decrease in the speed of the prime mover correspondingly decreases the speed of the pumping unit.

The foregoing and other features, utilities and advantages of the invention will be apparent from the following more particular description of a preferred embodiment of the invention as illustrated in the accompanying drawings.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which.

DETAILED DESCRIPTION

The word "exemplary" is used herein to mean "serving as an example, instance, or illustration." Any embodiment described as "exemplary" is not necessarily to be construed as preferred or advantageous over other embodiments. Moreover, any embodiments described should be considered exemplary unless otherwise specifically defined.

The technology associated with the present application will be explained with reference to FIGS. 1-4. While the description that follows relates to a coal/gas and oil well, one on ordinary skill in the art will recognize on reading the disclosure that the technology of the present application could be used in other applications, such as, for example, oil wells and other hydrocarbon production wells as well as any well where fluid level and hydrostatic pressure may cause technical difficulty with the well.

Figure 1:
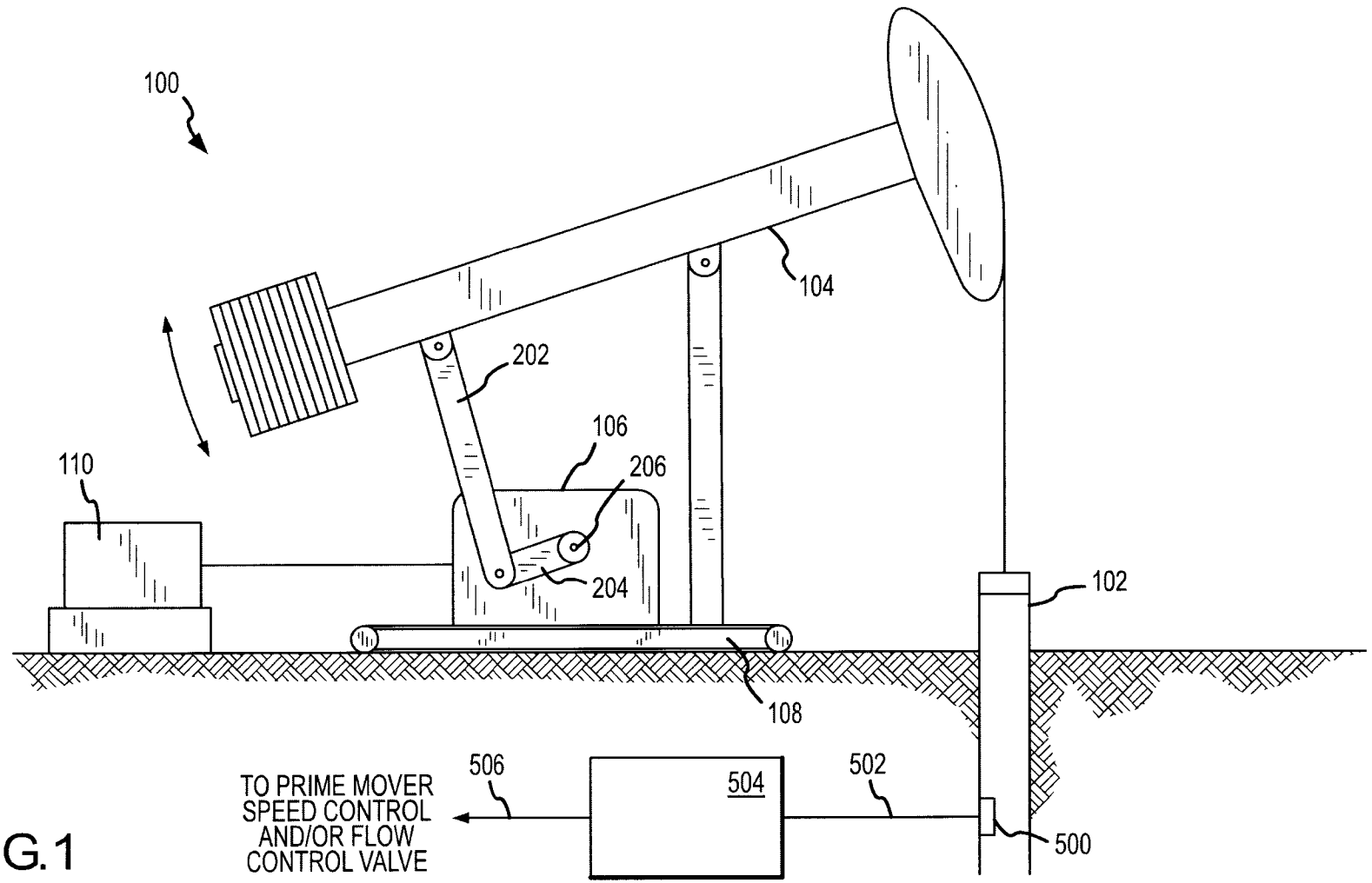
FIG. 1 is a functional block diagram of an exemplary embodiment of a pumping system constructed in accordance with the leading technology of the present application.

Referring now to FIG. 1, a pumping system 100 arranged about a wellbore 102 is shown. Pumping system 100 includes a pumping unit 104 and a pumping unit drive 106. Pumping unit 104 can be any conventional pump unit, such as, for example, an insert rod pump, as is generally known in the art and will not be further described herein. Pumping unit 104 and pumping unit drive 106 may be mounted on a skid 108 or the like. Pumping unit drive 106 is connected to a prime mover 110 as will be explained further below.

Figure 2:
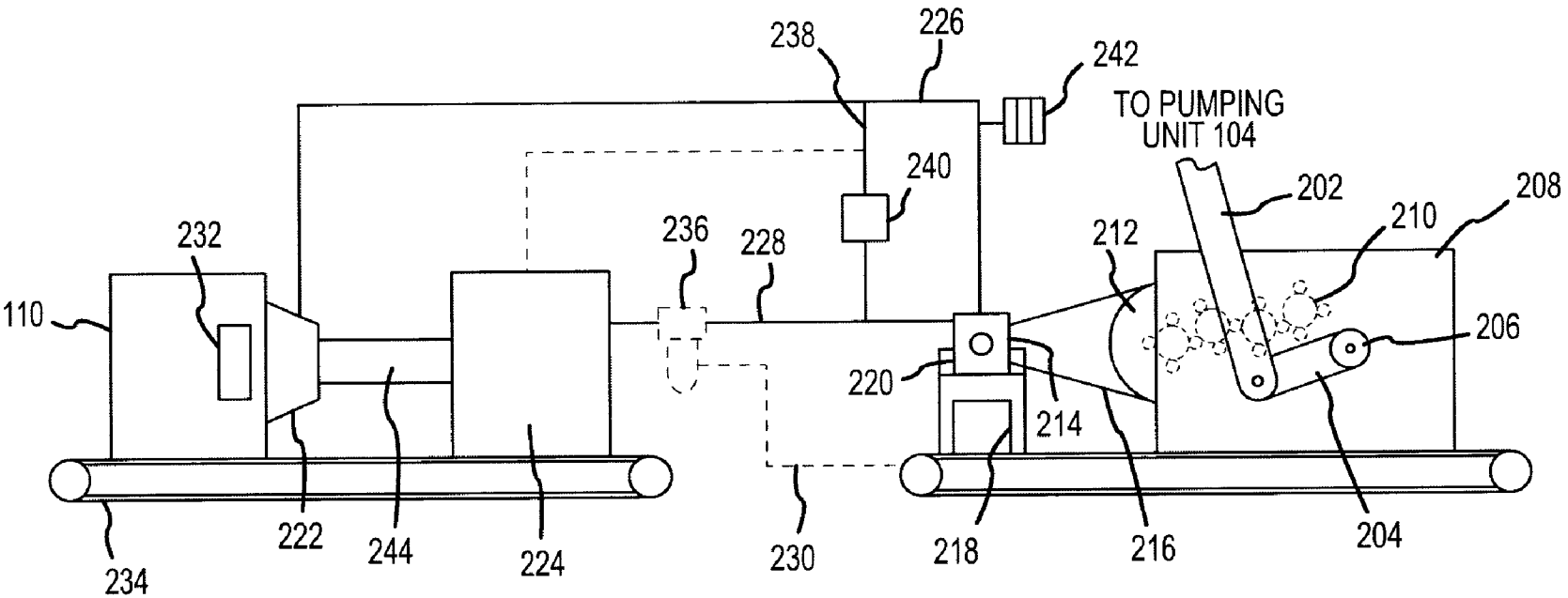
FIG. 2 is a functional block diagram showing aspects of FIG. 1 in more detail.

Referring now to FIGS. 1 and 2, pumping unit drive 106 and prime mover 110 are explained in more detail (sometimes referred to as a drive train). Pumping unit drive 106 includes an arm 202 pivotally coupled to both the pumping unit 104 and a crank arm 204. Crank arm 204 is coupled to a drive shaft 206 that rotationally moves the crank arm 204, which causes the pumping action of pumping unit 104.

A gear box 208 houses a series of reduction gears 210 (shown in phantom) connecting a driven sheave 212 to the drive shaft 206. The reduction gear ratio is largely a matter of design choice to facilitate the ability of the prime mover 110 to adjust the speed of pumping unit 104. The driven sheave 212 is connected to a hydraulic motor 214 by a drive belt 216. The hydraulic motor 214 causes the drive belt 216 to rotate the driven sheave 212 and the reduction gears 210 associated with gear box 208 rotate in response causing the drive shaft 206 to rotate at a desired speed, which controls the speed of pumping unit 104. The gear ratio of the reduction gear is largely a matter of design choice but needs to be sufficient that the hydraulic motor can drive the pumping unit.

The hydraulic motor 214 may be mounted on a stand 218 with motor mounts 220 to reduce vibrations and the like as is generally known in the art and not further explained herein.

The hydraulic motor 214 is in fluid communication with a hydraulic pump 222 and a fluid reservoir 224 via a fluid feed line 226, including a supply line 244 connecting hydraulic pump 222 and fluid reservoir 224, and a fluid return line 228. A case/skid drain return 230 is provided to recapture hydraulic fluid that leaks from the system internally, for example, through the seals associated with hydraulic motor 214 and pump 222. The Hydraulic pump 222 is coupled to prime mover 110, which may be an electric motor, a gas engine, or the like. Prime mover 110 includes an engine speed control 232. The speed control 232 is usable by an operator to increases or decreases the fluid flow from hydraulic pump 222 to hydraulic motor 214, which correspondingly increases or decreases the speed of hydraulic motor 214.

The prime mover 110, fluid reservoir 224, and hydraulic pump 222 may be mounted on a hydraulic skid 234 or contained on skid 108 as a matter of design choice.

Optionally, the fluid return line 228 and the case/skid drain return 230 may be connected to a filter 236. Filter 236 prevents debris from fouling the hydraulic system.

Also, optionally, a bypass line 238 connecting the fluid feed line 226 and the fluid return 228 may be provided. Alternatively, bypass line 238 may be connected directly to fluid reservoir 224 (as shown in phantom). Bypass line 238 may include a flow control valve 240, such as, for example, a simple ball valve. Flow control valve 240 may be used to trim the speed of the hydraulic motor 214 by bleeding off some of the fluid from the feed line. Bypass line 238 also could be used as an emergency cutout or the like. Flow control valve 240 alternatively could be a pressure release valve. Alternatively, a separate pressure release valve 242 may be provided in feed line 226.

Figure 3:
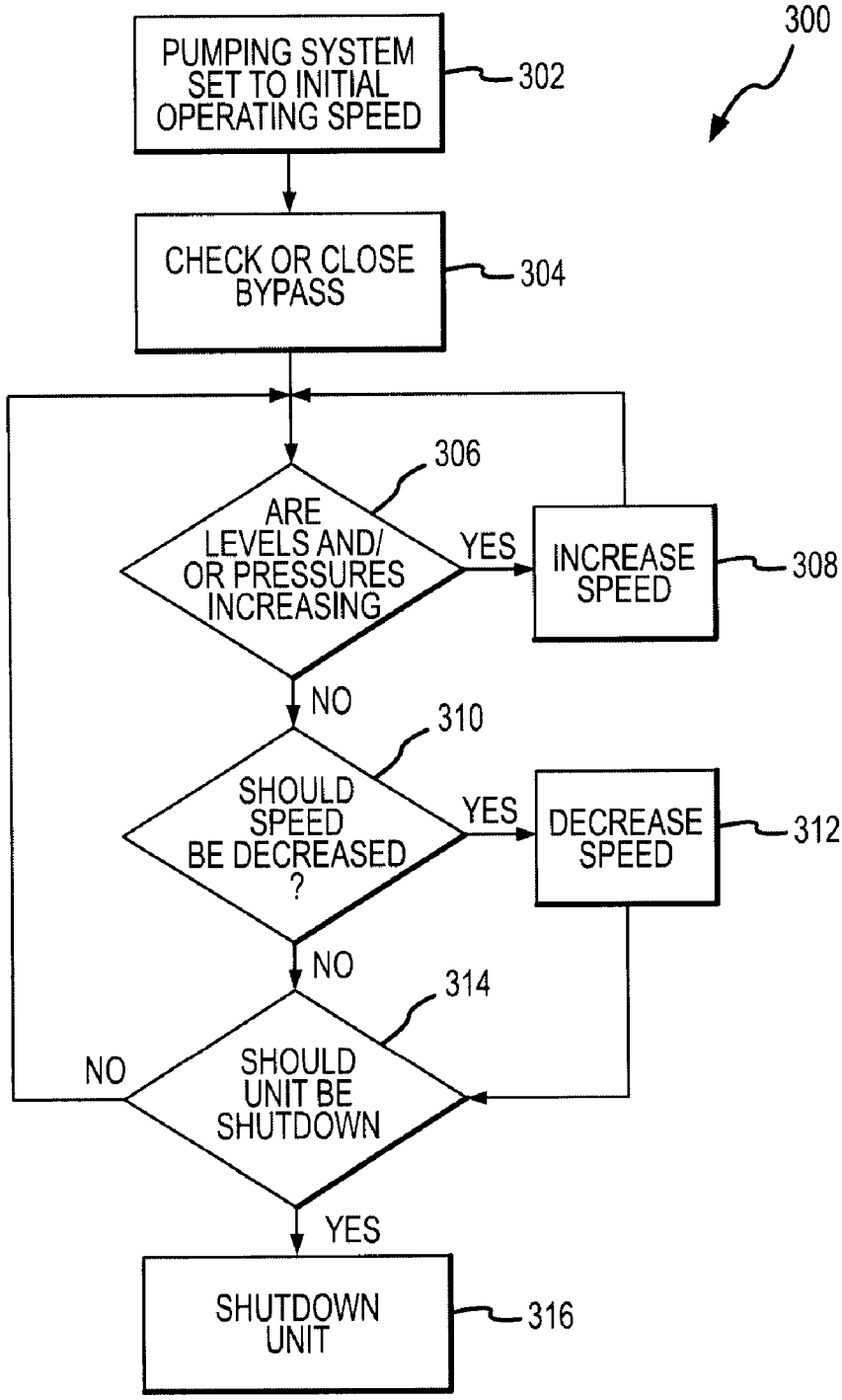
FIG. 3 is a functional block diagram showing an exemplary methodology of operating the pumping system of FIG. 1.

Referring now to FIG. 3, an exemplary method 300 of operating pumping system 100 is provided. Initially, the prime mover is set to a first operating speed, step 302. The operating speed of/prime mover corresponds to the pumping unit speed. The first operating speed is set to cause pumping unit 104 to sufficiently dewater the wellbore. For initial start up, the flow control valve 240 may need to be closed, or checked closed, step 304. Next, a determination is made if fluid levels and/or hydrostatic pressure is increasing in the well, step 306. If levels and/or pressures are increasing, the prime mover speed is increases, step 308. If levels and/or pressures are not increasing, a determination is made whether the speed of the prime move should be decreased, step 310. Such as decision could be made if fluid levels drop below a minimum operating level for the pumping unit 104. If it is decided to reduce the pump speed, the prime mover speed is reduced, step 312. Finally, it is determine whether the pumping unit 104 should be shut down, step 314. If a decision to shut down the unit is made, flow control valve 240 may be opened to bypass the hydraulic motor, step 316, shutting down the unit. If a decision not to shut down the unit is made, control returns to step 306.

Thus, as can be appreciated, speed control of the pumping unit 104 can be controlled and adjusted over a large range by an operator of the prime mover 110 using the engine speed control 232 and/or the flow control valve 240, as is explained below. The speed of the pumping unit 104 can be reduced to almost zero strokes per minute and up to a maximum operating speed, which is dependent on the gear box, hydraulic pump and motor capability, prime mover capability, etc. Moreover, the hydraulic system can be preset such that in the event the pumping unit sticks or clogs, the hydraulic unit will bypass or shut down, preventing further damage to the wellbore, although the pumping unit will need typical repairs, the trip will inhibit exasperating the problem.

Figure 4:
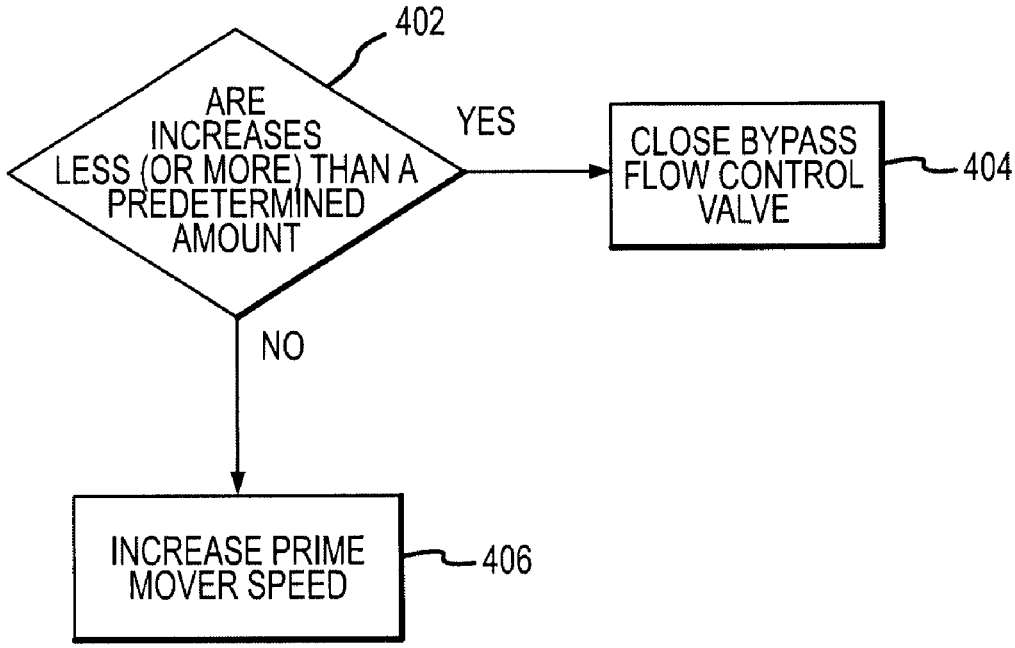
FIG. 4 is an alternative methodology for changing speeds of FIG. 3.

As mentioned above, flow control valve 240 may be used to trim, fine tune, or even grossly tune the speed of the pumping unit 104. Thus, as shown by FIG. 4, step 308 above could be replaced with the following series of operations. A further determination is made if fluid levels and/or hydrostatic pressure is increasing less (or more) than a predetermined amount, step 402. If fluid levels and/or hydrostatic pressure is increasing less (or more) than the predetermined amount, the flow control valve is closed to increase the speed of the pumping unit, step 404. If the fluid levels and/or hydrostatic pressure is increase more (or less) than a predetermined amount, the speed of the prime mover is increased, step 406. Similarly, a decrease in speed of the pumping unit could be accomplished by opening the flow control valve. Control of the speed of the pumping unit can be facilitated by an operator controlling the speed of the prime mover, the flow rate through the bypass line, or a combination thereof as a matter of design choice.

While the above method of operation diagrams are provided for illustration, one of ordinary skill in the art would recognize additional, other, or alternative orders for operational steps may be use in conjunction with the technology herein described.

Referring back to FIG. 1, it is possible to automate the control of the pumping unit 104. In particular, a sensor 500 may be provided down hole in the wellbore. Sensor 500 would provide a control signal 502 to a processor 504. The control signal may be, for example, a fluid level indication, a rate of fluid level change indication, a hydrostatic pressure indication, a rate of hydrostatic pressure change indication, a combination thereof, or the like. The processor 504 would determine using either a simple mathematical algorithm or a predefined look up table a pumping unit speed based on that sensed control signal. The processor 504 would provide a speed setting signal 506 to the prime mover engine speed control 232 that would correspondingly adjust the speed of prime mover 110. Processor 504 may provide a signal to adjust the setting on flow control valve 240 should flow control valve 240 be used to control speed of the system.

The steps of a method or algorithm described in connection with the embodiments disclosed herein may be embodied directly in hardware, in a software module executed by a processor, or in a combination of the two. A software module may reside in Random Access Memory (RAM), flash memory, Read Only Memory (ROM), Electrically Programmable ROM (EPROM), Electrically Erasable Programmable ROM (EEPROM), registers, hard disk, a removable disk, a CD-ROM, or any other form of storage medium known in the art. An exemplary storage medium is coupled to the processor such the processor can read information from, and write information to, the storage medium. In the alternative, the storage medium may be integral to the processor. The processor and the storage medium may reside in an ASIC. The ASIC may reside in a user terminal or operator control station. In the alternative, the processor and the storage medium may reside as discrete components in a user terminal.

The previous description of the disclosed embodiments is provided to enable any person skilled in the art to make or use the technology associated with the present application. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A system to remove liquid from a wellbore comprising:
a pumping unit to remove liquid from a wellbore;
a pumping unit drive coupled to the pumping unit;
a hydraulic motor coupled to the pumping unit drive;
a hydraulic pump coupled to the hydraulic motor via a feed line;
a fluid reservoir coupled to the hydraulic motor via a return line and coupled to the hydraulic pump via a supply line;
a bypass line coupling the feed line and the return line; and
a prime mover coupled to the hydraulic pump, wherein
the speed of the prime mover controls the speed of the pumping unit such that increasing the speed of the prime mover correspondingly increases the speed of the pumping unit and a decrease in the speed of the prime mover correspondingly decreases the speed of the pumping unit.

2. The system of claim 1, wherein the pumping unit comprises an insert rod pump.

3. The system of claim 1, wherein the prime mover comprises an electric motor.

4. The system of claim 1, wherein the prime mover comprises a gas engine.

5. The system of claim 1, further comprising a flow control valve in the bypass line.

6. The system of claim 1, wherein the wellbore is an oil well.

7. The system of claim 1, wherein the wellbore is a coal/gas well.

8. A system to remove liquid from a wellbore comprising:
a pumping unit to remove liquid from a wellbore;
a pumping unit drive coupled to the pumping unit;
a hydraulic motor coupled to the pumping unit drive;
a hydraulic pump in fluid communication with the hydraulic motor; and
a prime mover comprising a speed controller coupled to the hydraulic pump, wherein
the speed of the prime mover controls the speed of the pumping unit such that increasing the speed of the prime mover correspondingly increases the speed of the pumping unit and a decrease in the speed of the prime mover correspondingly decreases the speed of the pumping unit.

9. The system of claim 8, further comprising:
a sensor in the wellbore;
a processor coupled to the sensor;
the processor coupled to the speed controller; wherein
the sensor generates a control signal based on at least one condition of the wellbore that is transmitted to the processor, the processor receives the control signal and calculates a speed setting signal that is transmitted to the speed controller, and the speed controller uses the speed setting signal to control the speed of the prime mover and pumping unit.

10. A system to remove liquid from a wellbore comprising:
a pumping unit to remove liquid from a wellbore;
a pumping unit drive coupled to the pumping unit, wherein
the pumping unit drive comprises:
a driven sheave;
a plurality of reduction gears;
a drive shaft;
a crank arm; and
an arm, wherein
the driven sheave is coupled to the hydraulic motor via a drive belt, the driven sheave is coupled to the drive shaft via the plurality of reduction gears, the drive shaft is coupled to the pumping unit via the crank arm and the arm;
a hydraulic motor coupled to the pumping unit drive;
a hydraulic pump in fluid communication with the hydraulic motor; and
a prime mover coupled to the hydraulic pump, wherein
the speed of the prime mover controls the speed of the pumping unit such that increasing the speed of the prime mover correspondingly increases the speed of the pumping unit and a decrease in the speed of the prime mover correspondingly decreases the speed of the pumping unit.

11. A method for operating a pumping unit at variable and slow speeds comprising:
operating a pumping unit using a hydraulic drive system at an initial operating speed;
determining if fluid levels in a wellbore are increasing;
if fluid levels are increasing, increasing the speed of the pumping unit by increasing a hydraulic fluid flow to a hydraulic motor by decreasing fluid flow through a bypass line;
if fluid levels are not increasing; further determining whether the operating speed of the pumping unit should be decreased; and
if it is determined to decrease the speed of the pumping unit, decreasing the speed of the pumping unit by decreasing the hydraulic fluid flow to the hydraulic motor by increasing the fluid flow through the bypass line.

12. The method of claim 11, wherein the step of increasing the speed of the pumping unit includes increasing the speed of a prime mover of the hydraulic drive system and the step of decreasing the speed of the pumping unit includes decreasing the speed of the prime mover.

* * * * *